US008450993B2

(12) United States Patent
Yang

(10) Patent No.: US 8,450,993 B2
(45) Date of Patent: May 28, 2013

(54) SEMICONDUCTOR BUCK CIRCUIT WITH FLOATING-VOLTAGE SUPPRESSION SHUNTING CURRENT LOAD

(76) Inventor: Tai-Her Yang, Dzan-Hwa (TW)

( * ) Notice: Subject to any disclaimer, the term of this patent is extended or adjusted under 35 U.S.C. 154(b) by 398 days.

(21) Appl. No.: 12/659,589

(22) Filed: Mar. 15, 2010

(65) Prior Publication Data

US 2011/0221403 A1 Sep. 15, 2011

(51) Int. Cl.
*G05F 1/618* (2006.01)

(52) U.S. Cl.
USPC ..... 323/329; 323/231

(58) Field of Classification Search
USPC ..... 323/220, 229
See application file for complete search history.

(56) References Cited

U.S. PATENT DOCUMENTS 6,320,452 B1 * 11/2001 Chen ..... 327/530
7,242,566 B2 * 7/2007 Yegin et al. ..... 361/111

* cited by examiner

*Primary Examiner* — Adolf Berhane
*Assistant Examiner* — Emily Pham
(74) *Attorney, Agent, or Firm* — Bacon & Thomas, PLLC

(57) ABSTRACT

The present invention relates to a conventional circuit connected with the direct-current (DC) power supply in series through the semiconductor forward voltage drop, for producing voltage drop to lower the output DC voltage, however, if the output current is smaller, the voltage drop produced is not enough, the floating-voltage accordingly rises and damages the load, so a shunting current load is arranged in the circuit to suppress the floating-voltage.

6 Claims, 1 Drawing Sheet

SEMICONDUCTOR BUCK CIRCUIT WITH FLOATING-VOLTAGE SUPPRESSION SHUNTING CURRENT LOAD

BACKGROUND OF THE INVENTION (a) Field of the Invention

The present invention relates to a conventional circuit connected with the direct-current (DC) power supply in series through the semiconductor forward voltage drop, for producing voltage drop to lower the output DC voltage, however, if the output current is smaller, the voltage drop produced is not enough, the floating-voltage accordingly rises and damages the load, so a shunting current load is arranged in the circuit to suppress the floating-voltage.

(b) Description of the Prior Art

The conventional semiconductor element produces forward voltage drop (VF) with the passing current, which is characterized in that if the current varies between the minimum and the saturation, the forward voltage drop (VF) will become smaller with the current becomes smaller, thus, if a semiconductor is used for series buck, the series buck value is unstable because of current variation from small value to large one.

SUMMARY OF THE INVENTION

The semiconductor buck circuit with floating-voltage suppression shunting current load of the present invention relates to a circuit, in which two or more semiconductor elements with the forward voltage drop (VF) exist and the forward voltage drop (VF) varies with the value of the passing current before saturation, the semiconductor elements such as Zener diodes, forward series diodes, or LEDs, connect with the direct-current power supply in series to lower the DC output voltage, and the characterized is that the basic load current is produced between the series connected semiconductor elements and the other end of the power supply, and then the basic forward voltage drop (VF) is further produced.

DESCRIPTION OF MAIN COMPONENT SYMBOLS (101): First semiconductor buck element
(102): Second semiconductor buck element
(103): Shunting current load
(104): Control device
(105): Zener diode

DETAILED DESCRIPTION OF THE PREFERRED EMBODIMENTS

The semiconductor buck circuit with floating-voltage suppression shunting current load of the present invention relates to a circuit, in which two or more semiconductor elements with the forward voltage drop (VF) exist and the forward voltage drop (VF) varies with the value of the passing current before saturation, the semiconductor elements such as Zener diodes, forward series diodes, or LEDs, connect with the direct-current power supply in series to lower the DC output voltage, and the characterized is that the basic load current is produced between the series connected semiconductor elements and the other end of the power supply, and then the basic forward voltage drop (VF) is further produced.

Figure 1:
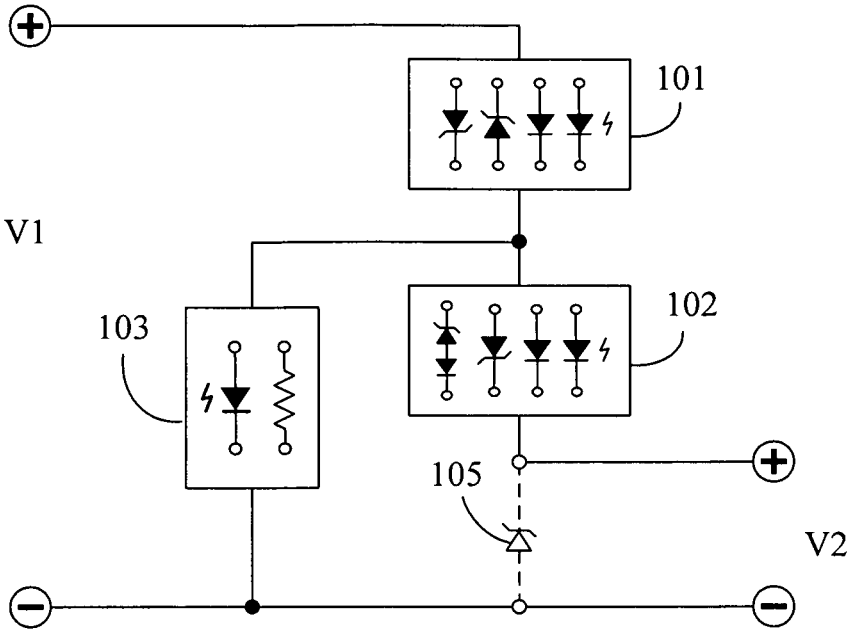
FIG. 1 is a block diagram showing the first circuit of the semiconductor buck circuit with floating-voltage suppression shunting current load, according to the present invention.

FIG. 1 is a block diagram showing the first circuit of the semiconductor buck circuit with floating-voltage suppression shunting current load, according to the present invention; the main components including:

first semiconductor buck element (101): constituted by one or more series, parallel, or series-parallel connected semiconductor elements with the forward voltage drop (VF) produced with the passing current, including Zener diodes, which have forward Zener voltage or reverse but forward voltage feature of similar diode, and/or diodes with forward voltage drop, and/or LEDs; in which the first semiconductor buck element (101) is for forward connecting with the anode of a direct-current power supply V1 in series, and then connecting with the anode of a second semiconductor buck element (102) and the anode of a shunting current load (103);

the second semiconductor buck element (102): constituted by one or more series, parallel, or series-parallel connected diodes, and/or LEDs, and/or Zener diodes, which have the Zener voltage higher than the output voltage (V2) and arranged in the diode functional diversion direction, or the diode group, which is constituted by the Zener diode connecting with the diodes in series and has one-way conductive features; in which the anode of the second semiconductor buck element (102) is for connecting with the output end of the first semiconductor buck element (101) and the anode of the shunting current load (103), and the output end of the second semiconductor buck element (102) is used as the output end of the anode outputting DC power; and shunting current load (103): constituted by one or more than one kind of LEDs and/or resistive elements which are series, parallel, or series-parallel connected by one or more than ones; in which the anode of the shunting current load (103) is for connecting with the output end of the first semiconductor buck element (101) and the anode of the second semiconductor buck element (102), and the output end of the shunting current load (103) is for connecting with the cathode of the direct-current power supply V1 and the cathode of the DC output power supply V2.

In the above embodiment in FIG. 1, the output end of the direct-current power supply connects with a Zener diode (105) used for limiting the voltage or a circuit device with same function in parallel as needed.

Figure 2:
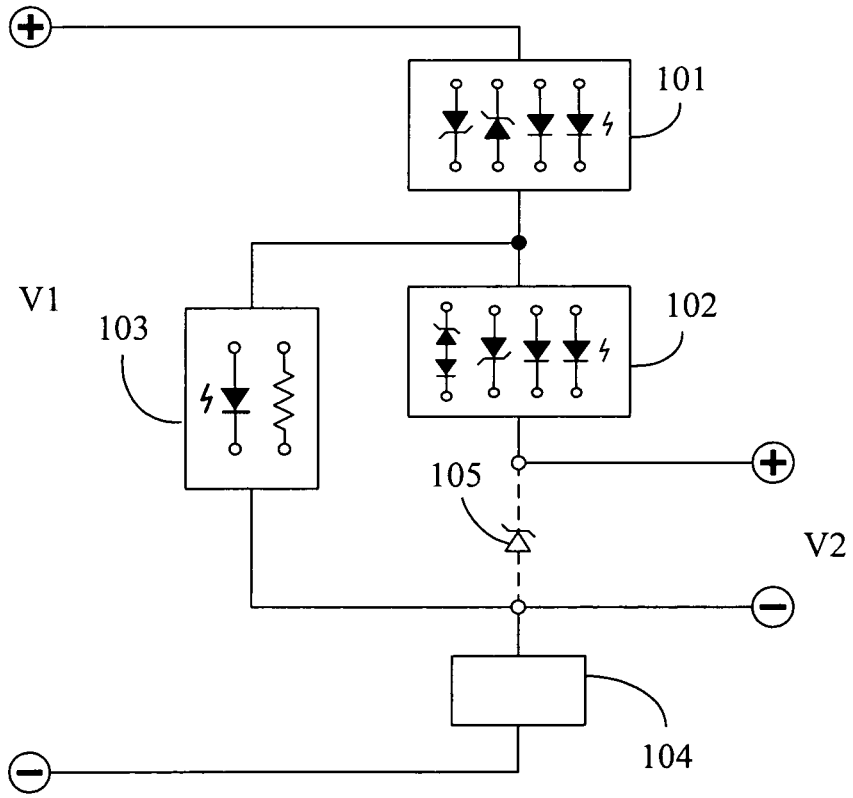
FIG. 2 is a block diagram showing the second circuit of the semiconductor buck circuit with floating-voltage suppression shunting current load, according to the present invention.

For the semiconductor buck circuit with floating-voltage suppression shunting current load, a control device (104) connecting with the power supply in series is further installed for controlling the ON or OFF operation for the direct-current power supply V1, or controlling the voltage V1 of the direct-current power supply to be variable voltage, constant voltage, or limited voltage, and/or controlling the output current of the direct-current power supply V1 to be variable current, constant current, or limited current; FIG. 2 is a block diagram showing the second circuit of the semiconductor buck circuit with floating-voltage suppression shunting current load, according to the present invention, the main components including:

first semiconductor buck element (101): constituted by one or more series, parallel, or series-parallel connected semiconductor elements with the forward voltage drop (VF) produced with the passing current, including Zener diodes, which have forward Zener voltage or reverse but forward voltage feature of similar diode, and/or diodes with forward voltage drop, and/or LEDs;

the second semiconductor buck element (102): constituted by one or more series, parallel, or series-parallel connected diodes, and/or LEDs, and/or Zener diodes, which have the Zener voltage higher than the output voltage (V2) and arranged in the diode functional diversion direction, or the diode group, which is constituted by the Zener diode connecting with the diodes in series and has one-way conductive features;

shunting current load (103): constituted by one or more than one kind of LEDs and/or resistive elements which are series, parallel, or series-parallel connected by one or more than ones; and control device (104): constituted by the electromechanical device, and/or the solid state electronic switch element, and/or microprocessor, and/or software, for controlling the ON or OFF operation for the direct-current power supply V1, or controlling the voltage V1 of the direct-current power supply to be variable voltage, or constant voltage, or limited voltage, and/or controlling the output current of the direct-current power supply V1 to be variable current, or constant current, or limited current.

In the above embodiment in FIG. 2, the output end of the direct-current power supply connects with the Zener diode (105) used for limiting the voltage or a circuit device with same function in parallel as needed.

The invention claimed is:

1. A semiconductor buck circuit with floating-voltage suppression, comprising:

a first semiconductor buck element (101) having an anode and an output end;

a second semiconductor buck element (102) having an anode and an output end; and a shunting current load (103) having an anode and an output end, wherein:

the anode of the first semiconductor buck element (101) is connected to an anode of a direct current power supply (V1) and the output end of the first semiconductor buck element (101) is connected to the anode of the second semiconductor buck element (102) and the anode of the shunting current load, whereby the first semiconductor buck element (101) is forward series connected between the anode of the direct current power supply (V1) and respective anodes of the second semiconductor buck element (102) and the shunting current load (103), the output end of the shunting current load (103) is connected to a cathode of a DC output power supply (V2), and the output end of the second semiconductor buck element (102) is connected to an anode of the DC output power supply V2, wherein said shunting current load (103) limits a voltage drop across the DC output power supply (V2) in response to a decrease in input voltage from the direct current power supply (V1), wherein the first semiconductor buck element (101) and the second semiconductor buck element (102) each include series, parallel, or series-parallel connected diodes or LEDs and at least one Zener diode, and wherein the shunting current load includes at least one of a resistive element, an LED, and a combination of at least one resistive element and at least one LED, and wherein the second semiconductor buck element (102) is connected in series with at least one Zener diode, and a Zener voltage of the at least one Zener diode in a normal state is higher than a voltage of the DC output power supply (V2).

2. A semiconductor buck circuit with floating-voltage suppression as claimed in claim 1, further comprising a control device (104) connected to the output of the shunting current load (103) and between a cathode of the direct current power supply (V1) and the cathode of the DC output power supply (V2) for controlling at least one of an on/off operation and an output voltage or current of the direct current power supply (V1).

3. A semiconductor buck circuit with floating-voltage suppression as claimed in claim 2, further comprising a voltage-limiting circuit device connected between the anode and cathode of the DC output power supply (V2).

4. A semiconductor buck circuit with floating-voltage suppression as claimed in claim 3, wherein the voltage-limiting circuit device is a Zener diode.

5. A semiconductor buck circuit with floating-voltage suppression as claimed in claim 1, further comprising a voltage-limiting circuit device connected between the anode and cathode of the DC output power supply (V2).

6. A semiconductor buck circuit with floating-voltage suppression as claimed in claim 5, wherein the voltage-limiting circuit device is a Zener diode.

* * * * *